US005544957A

United States Patent [19]

Schmidt et al.

[11] Patent Number: 5,544,957

[45] Date of Patent: Aug. 13, 1996

[54] LOCKING MECHANISM FOR MULTIPLE VERTICAL DRAWERS

[75] Inventors: Clayton C. Schmidt, Wilton; Chris Zorich, Muscatine, both of Iowa; Arthur E. Lammens, Fullerton; Jackie D. Parvin, Pomona, both of Calif.

[73] Assignee: Hon Industries Inc., Muscatine, Iowa

[21] Appl. No.: 539,773

[22] Filed: Oct. 5, 1995

Related U.S. Application Data

[63] Continuation of Ser. No. 175,952, Dec. 30, 1993, abandoned.

[51] Int. Cl.[6] ..... E05C 7/06

[52] U.S. Cl. ..... 312/221; 312/216

[58] Field of Search ..... 312/221, 216, 312/222, 295, 333

[56] References Cited

U.S. PATENT DOCUMENTS

| | | | |
|---|---|---|---|
| 2,240,067 | 4/1941 | Bolesky et al. | 312/295 X |
| 3,969,008 | 7/1976 | Pergler | 312/221 |
| 4,865,404 | 9/1989 | Harper | 312/221 |
| 4,936,640 | 6/1990 | Pratzer | 312/221 |

FOREIGN PATENT DOCUMENTS

| | | | |
|---|---|---|---|
| 2523631 | 9/1983 | France | 312/221 |
| 3412072 | 10/1985 | Germany | 312/221 |

*Primary Examiner*—Peter M. Cuomo
*Assistant Examiner*—David E. Allred
*Attorney, Agent, or Firm*—Jones, Day, Reavis & Pogue

[57] ABSTRACT

A locking assembly for a plurality of vertically aligned drawers in a housing that includes a locking member associated with at least each of the drawers and wherein the locking member is arranged for reciprocal vertical movement relative to the housing. A slide mechanism is associated with each of the drawers with each of the slide mechanisms being aligned perpendicular to the locking mechanism and being arranged for reciprocal horizontal extension to move the drawers between closed and opened positions with respect to the housing. Each of the slide mechanisms for at least each of the drawers other than the uppermost drawer includes a ramp section that is structured and dimensioned to engage the locking member when at least any one of the drawers other than the uppermost drawer is opened such that the remaining drawers are locked in a closed position.

3 Claims, 4 Drawing Sheets

LOCKING MECHANISM FOR MULTIPLE VERTICAL DRAWERS

This application is a continuation of application Ser. No. 08/175,952, filed on Dec. 30, 1993, now abandoned.

FIELD OF THE INVENTION

The present invention relates in general to a locking assembly for vertically arranged multiple drawers and specifically to a locking arrangement having a vertically moveable locking bar or element operated by ramps formed on the outer end of a telescoping drawer slide mechanism such that as a drawer is opened, the ramp on the telescoping slide mechanism engages a projection on the vertically moveable locking element and locks all other drawers such that only one drawer can be opened at any one time.

THE BACKGROUND OF THE INVENTION

There are many vertically arranged file or storage drawers in the prior art. These drawers are contained in a housing such as a file cabinet or a desk. Typically associated with filing cabinets is a locking arrangement such that only one drawer can be opened at a time. This is particularly important when tall filing cabinets are used since, if more than one drawer is opened at a time, the pulling on the second drawer, and the weight of the material in that drawer may, produce a moment arm force which will tend to tip the file cabinet over. The weight of one loaded drawer, however, will not produce tipping. If a second loaded drawer is opened, the weight of both open drawers may tip the filing cabinet over depending upon the loaded condition of the unopened drawers. Thus, locking mechanisms are associated with such vertically arranged drawers to insure that only one drawer can be opened at any one given time. This is generally accomplished by a first mechanism placed on an elongated locking rod with an associated second mechanism being associated with each individual drawer. Thus, when one drawer is opened, the second mechanism on the drawer interfaces with the associated first mechanism and moves the locking rod upwardly so that projections engage mating portions on each drawer, thereby locking the other drawers so they cannot open.

Locking mechanisms of this type are rather elaborate and difficult to manufacture and install. Further, each element on the elongated locking rod must be carefully placed so that it will properly engage the associated mechanism on the associated drawer. If a problem occurs with any of the elements, then the entire unit must be dismantled and the locking mechanism replaced to insure proper operation thereof.

Thus, it would be beneficial to have a simplified locking arrangement that locks all other drawers in place when one particular drawer has been opened, and prevents all other drawers from being opened.

SUMMARY OF THE INVENTION

The present invention overcomes the disadvantages of the prior art by associating a uniformly constructed slidable locking element with each drawer of a filing cabinet except the top drawer. The uniformly constructed slidable locking elements are vertically arranged in axial alignment with each other. A ramp device is formed on the outer end of a telescopic slide mechanism associated with each drawer. When the slide mechanism comprises outer, inner and intermediate slide elements, the ramp device may be found on either the intermediate or inner slide elements. In such construction, a first projection on each of the uniformly constructed slidable locking elements associated with each drawer, other than the top drawer, is engaged by the ramp on the associated slide mechanism when the drawer is opened, thus, moving all axial aligned locking elements above it. A second projection on each raised locking element prevents the next upper drawer from being opened by blocking the movement of the slide mechanism therefore.

A third tab or projection optionally may be provided on the locking element. This third tab rests on top of its associated slide mechanism only when the slide mechanism is retracted and the drawer is in the closed position thus limiting the downward movement of the slidable locking element as the slide mechanism is retracted. Further, the second tab or projection on the locking element under and adjacent the slide mechanism of any open drawer engages and is blocked from moving upwardly by the extended slide of the open drawer when an attempt is made to open the drawer below the open drawer. Thus, all drawers below the open drawer are prevented from being opened.

Accordingly, it is an object of the present invention to provide a locking assembly for a housing having vertical multiple drawers in which a locking mechanism is actuated by a ramp on an element of the slide mechanism of the first drawer that is opened in a manner such that all of the remaining vertically aligned drawers are locked in the closed position.

Another object of the present invention is to provide a plurality of uniformly constructed locking elements, at least one of which is associated with each drawer slide mechanism in a manner such that a ramp on an element of the slide mechanism actuates one of the multiple locking elements and locks the remaining drawers in the closed position.

Thus, the present invention relates to a locking assembly for a plurality of slidable drawers vertically arranged in a housing comprising a locking element associated with each drawer except the top drawer and supported in the housing for reciprocal vertical sliding movement, an elongated slide mechanism associated with each drawer for horizontal extension and retraction when the drawer is opened and closed, a projection on each locking element, and a ramp associated with the slide mechanism for at least each drawer other than the top drawer such that horizontal extension of any slide mechanism when opening a drawer other than the top drawer causes the ramp to engage with its corresponding locking element projection to move the vertical sliding lock element upwardly to lock in a closed or shut position all vertically higher drawers and to prohibit vertical movement of the locking elements associated with drawers below the open drawer thereby also locking such vertically lower drawers closed or shut. Thus, all drawers other than the open drawer are locked in a closed or shut position by operation of the present locking mechanism so that only one-drawer can be opened at a time.

BRIEF DESCRIPTION OF THE DRAWINGS

These and other objects of the present invention will be more fully disclosed in the following detailed description of the drawings in which like numerals represent like elements and in which.

DETAILED DESCRIPTION OF THE DRAWINGS

Figure 1:
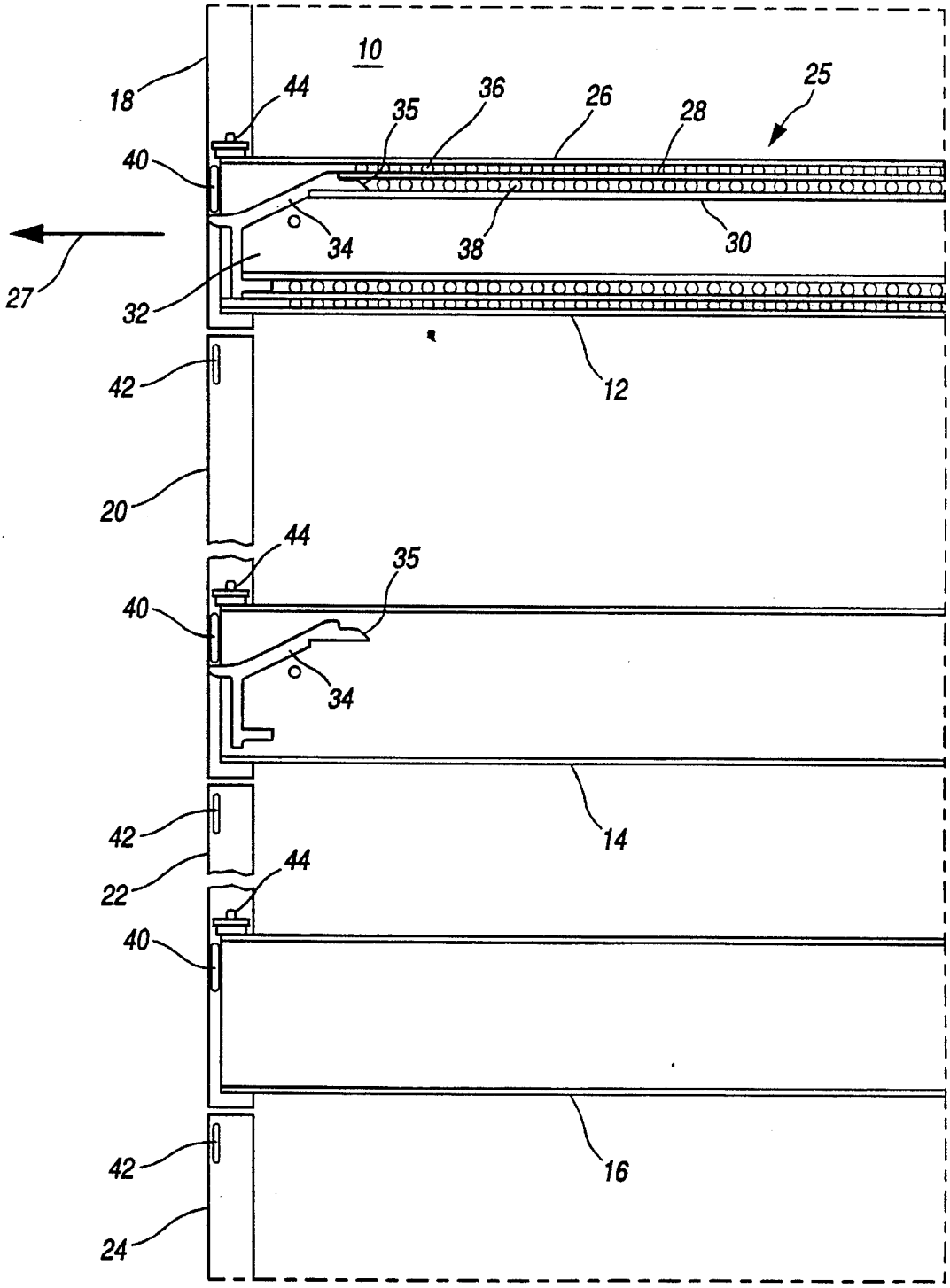
FIG. 1 is a schematic representation of a partial view of one side of a housing such as a filing cabinet illustrating the slide mechanism and locking element for at least each drawer other than the top drawer and the interrelationship of the components such that when one drawer is opened, the other drawers are locked and cannot be opened.

The novel invention herein is illustrated in FIG. 1 which is a partial diagrammatic representation of the inside of a housing for file drawers such as a file cabinet. The housing is designated generally by the numeral 10. Attached to the housing 10 are a plurality of spaced sliding mechanisms 12, 14 and 16. Only sliding mechanism 12 is illustrated in detail since the sliding mechanisms 14 and 16 are identical.

Figure 2:
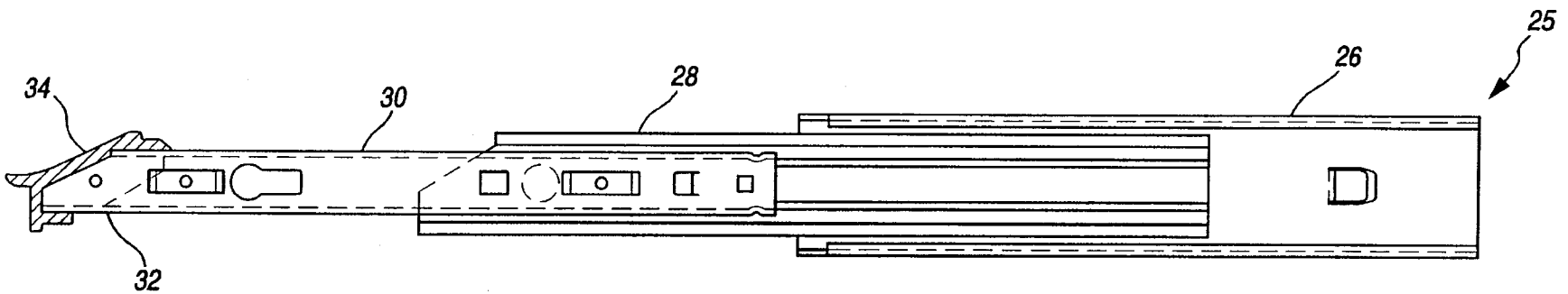
FIG. 2 is a side view of a slide mechanism in its fully extended position illustrating the outer, center, and inner sections that are telescopically related and illustrating the ramp on the outer end of the inner sliding mechanism for actuating the locking element.

As can be seen in FIG. 1, and more clearly in FIG. 2, sliding mechanism 12 moves in an essentially horizontal plane and comprises multiple telescoping sections 26, 28 and 30 that nest one within the other and are separated by and move on ball bearings 38. Clearly, two or more telescoping sections could be used but the preferred embodiment is shown in FIG. 1. Section 26 is the outer section, section 28 is the center or intermediate section, and section 30 is the inner section. It will be noted that on the outer end 32 of the inner section 30 there is a ramp 34 attached thereto by any well-known means such as a rivet (not shown). However, the ramp 34 could be attached to the center or intermediate section 28 as well and is to be considered an equivalent embodiment. The ramp may be formed of any well-known low friction material such as plastic, nylon and the like. Locking bar 17 carrying locking elements 18, 20, 22 and 24 extend vertically in front of the slide ramp 34 on the outer end 32 of the inner slide section 30 in axial alignment with each other for reciprocal vertical movement.

When the drawer associated with slide mechanism 25 is pulled outwardly in the direction of arrow 27, as shown in FIG. 1, ramp 34 engages a projection 40 on locking element 18 of bar 17 and forces the projection 40 in an upward direction as it rides up the ramp 34. When it does so, a second projection 42, shown on locking elements 20, 22, and 24, is positioned in blocking relationship with the slide mechanism 25 for the drawer above the one being opened. Thus, the upper drawer cannot be opened because second projection 42 blocks the movement of the sliding mechanism 25.

In like manner, because slide mechanism 25 is extended horizontally as a drawer is opened, if an attempt is made to open a drawer below the open drawer, the ramp member 34 on the drawer that is attempted to be opened will engage first projection 40 on the locking rod or member 20 in order to force it upwardly as explained previously. However, projection 42 on the locking member associated with the drawer that is being opened will contact the already horizontally extended slide member 28 of slide mechanism 25 of the next higher drawer already opened thus preventing upward movement of locking elements 20, 22 and 24 below the open drawer. In such manner, once one drawer is opened, the other drawers above and below that drawer are prevented from opening by means of the locking elements 18, 20, 22, 24 and the like. It should be noted that a third tab or projection 44 may optionally be positioned on each of the illustrated locking members 18, 20, and 22. This third projection or tab 44 rests on the outer member 26 of the slide mechanism 25 when the drawer is in a closed position. This projection 44 is a motion limiting projection or tab which acts in a manner such that as a drawer is closed and the vertically displaced locking element 18, for example, moves downwardly, the element 18 will stop at the proper position when tab or projection 44 engages the outer section 26 of the slide mechanism 25.

Thus, with the novel invention shown herein, utilizing the ramps 34 on the outer ends of the sliding mechanism 25, and using uniformly constructed locking elements such as 18, 20, 22 and 24, an assembly can be made that is very economical since the parts are identical and, if any part should malfunction, only that part needs to be replaced. Further, it is simple in operation and should be extremely durable.

It should be noted that ramp 34 has a small reverse ramp 35 on the back side. The top of ramp 34 is substantially even with the top of center slide 28. Normally inner slide 38 and center slide 28 move together when the drawer opens. In such case, the projection 40 rides up the front face 33 of ramp 34 best illustrated in FIGS. 1 and 2 on to the top of center slide 28 as the drawer opens. If the slide sequencing fails, e.g., the center slide 28 malfunctions and does not move with inner slide 30, then projection 40 rides up front face 33 of ramp 34 and rides down reverse ramp 35 onto the top of inner slide 30. In such case, when the drawer is closed, projection 40 can ride up reverse ramp 35 over the top thereof as the drawer moves in a closing direction and then down front face 33 of ramp 34 allowing the drawer to be properly dosed. If the projection 40 could not ride up ramp 34, it would lock the drawer in the partially open position.

Figure 4:
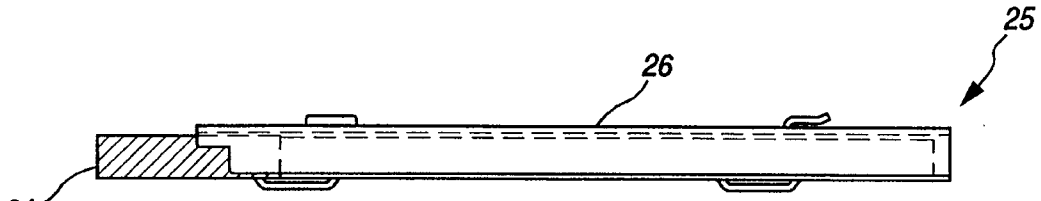
FIG. 4 is a top view of the sliding mechanism in its fully retracted position.
Figure 3:
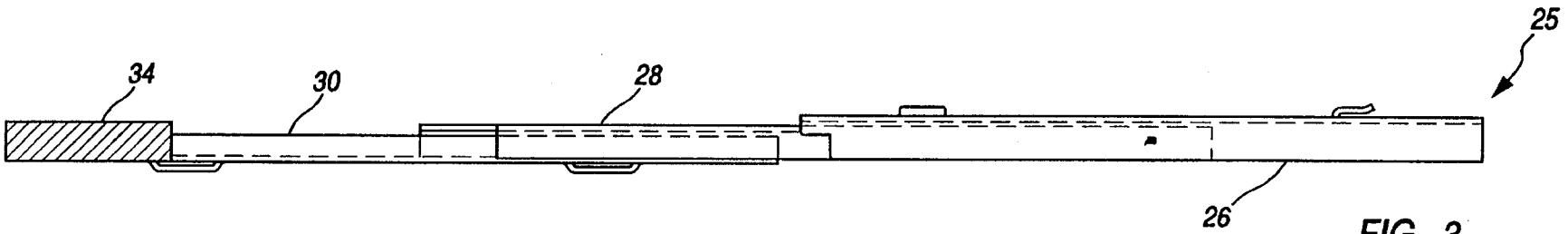
FIG. 3 is the top view of the extended bracket illustrated in FIG. 2.

FIG. 2 is a side view of one of the slide mechanisms 25 in its fully extended position illustrating the outer section 26, the center section 28 and the inner section 30 with the ramp 34 on the outer end 32 thereof. FIG. 3 is a top view of the extended slide mechanism 25 shown in FIG. 2. Again, the three telescoping sections can be clearly seen with the ramp 34 on the outer end of the inner slide section 30. FIG. 4 illustrates the sliding mechanism 25 in its fully telescoped position.

Figure 5:
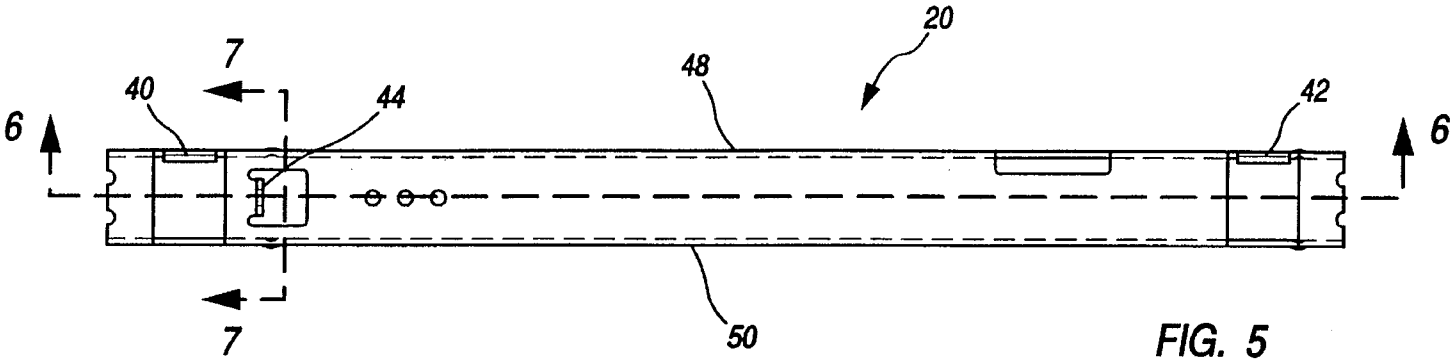
FIG. 5 is a plan view of one of the uniformly constructed locking elements that is actuated by the ramp on the end of the sliding assembly.

FIG. 5 is a plan view of one of the uniformly constructed locking elements or members designated by the numerals 18, 20, 22 and 24 in FIG. 1. The first projection or tab 40 that is structured and positioned to engage the ramp 34 on the sliding mechanism 25 as described previously and extends outwardly from one wall 48 of the locking member 20.

Figure 7:
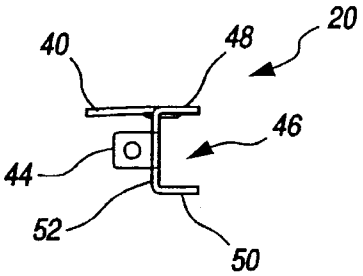
FIG. 7 is a cross-sectional view of the locking element taken along lines 7—7 of FIG. 5.

Locking member 20 is generally U-shaped as can be seen in FIG. 7 and the first projection 40 extends outwardly from one of the walls 48 of the U-shaped construction. The second projection or tab 42 also extends outwardly from the same wall 48 and, as stated previously, when the locking member 20 is forced upwardly by ramp 34 on the associated slide mechanism 25, second projection 42 is moved upwardly into the path of ramp 34 on member 30 of the next higher telescoping sliding mechanism 25 so that it cannot extend outwardly thus locking that drawer. Since all axially aligned locking elements above the drawer being opened are moved upwardly by the locking element or member 20, they lock all other drawers above the open drawer in like manner. Finally, the third projection or tab 44 can be seen projecting outwardly from the base of the U-shaped locking member 20 and which, as will be recalled, serves as a limiting stop to rest on the outer section 26 of the slide member 25 as illustrated in FIG. 1 when a drawer is closed and the locking member 20 returns to its original position.

Figure 6:
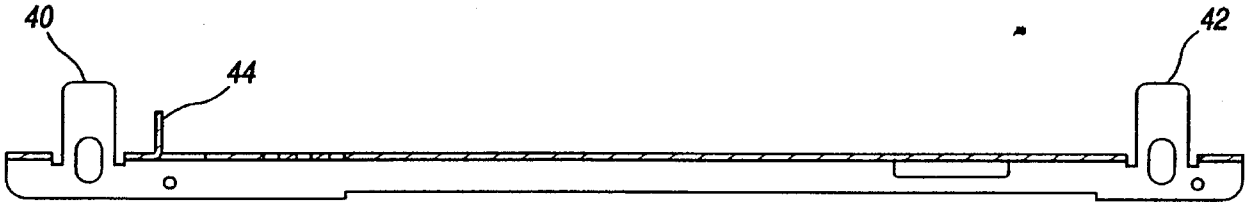
FIG. 6 is a cross-sectional view of the locking bar taken along lines 6—6 of FIG. 5.

FIG. 6 is a cross-sectional view of the locking member 20 taken along lines 6—6 of FIG. 5. Again, the first projection 40, second projection 42 and the optional third projection 44 can be clearly seen. FIG. 7 is a cross-sectional view of the locking member 20 taken along lines 7—7 of FIG. 5. The U-shaped channel 46 can be clearly seen with its side walls 48 and 50 and the bottom wall 52. The third tab member or projection 44 can be seen as extending from the bottom wall and the first projection 40 can be seen extending from the side wall 48.

Figure 9:
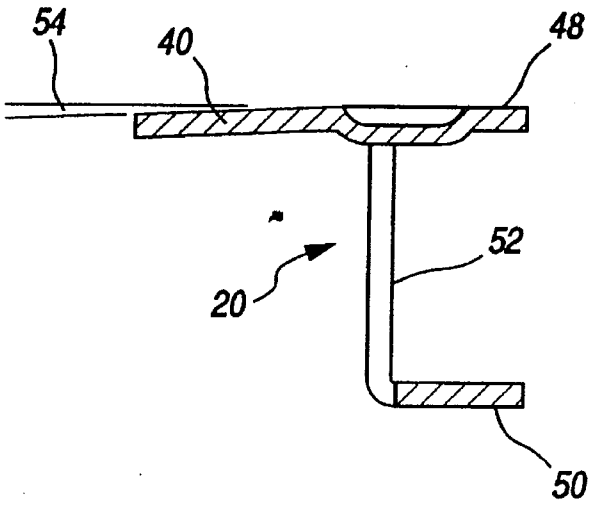
FIG. 9 is a cross-sectional view taken along lines 9—9 of FIG. 8 and illustrating the projection or tab on the locking element that is engaged by the ramp on the sliding mechanism.
Figure 8:
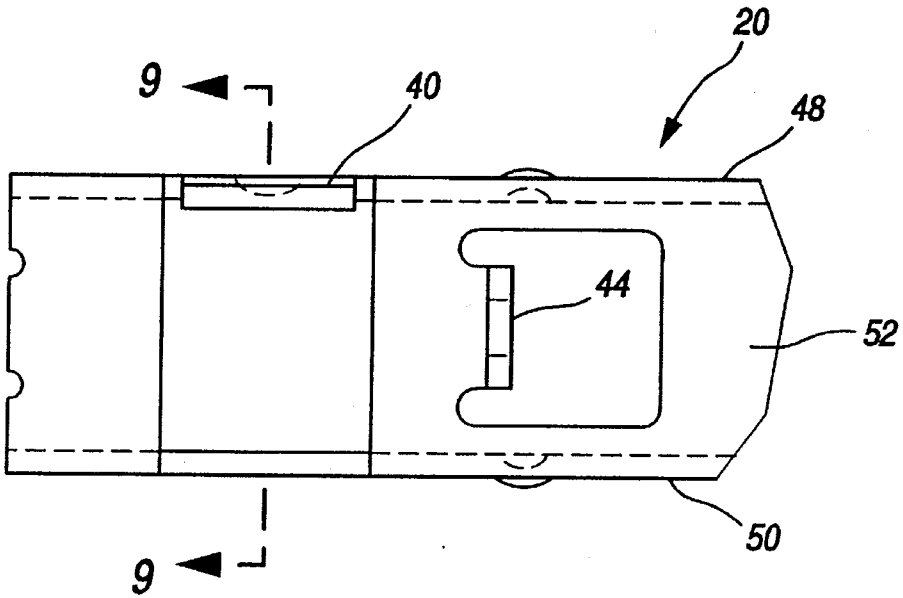
FIG. 8 is an enlarged plan view of one end of the locking element illustrating the tab or projection that is engaged by the ramp on the sliding mechanism as well as the tab limiting downward movement of the locking element when a drawer is closed.

FIG. 8 is a detailed enlarged section of the locking member 20 illustrating the first projection 40 extending from sidewall 48 and third projection 44 extending from the base or bottom 52 of the U-shaped channel 46. FIG. 9 is a cross-sectional view of the locking member 20 taken along lines 9—9 of FIG. 8 so that the construction of the first projection 40 that engages the ramp 34 can be clearly seen. A plastic covering, not shown, may be placed over projection 40 to cause it to interact more easily with the plastic ramp 34. Note that projection 40 forms a small angle 54 with the horizontal in FIG. 9 to provide proper clearance with the housing. It should be noted that substantially U-shaped locking member 20 slides only a short distance vertically and therefore is mounted on any well-known guide such as an elongated rectangular projection on the housing 10 that interconnects with the U-shaped portion 46 of locking member 20.

Thus, there has been disclosed a novel locking assembly for a plurality of vertically aligned file drawers in a housing. The locking assembly comprises a locking member or element associated with each of the drawers other than the top drawer. The locking element is arranged for reciprocal vertical movement relative to the housing. A slide mechanism is associated with each of the drawers with each of the slide mechanisms being aligned perpendicular to its corresponding locking member. Each of the slide mechanisms is arranged for reciprocal horizontal extension to move the drawers between closed and opened positions with respect to the housing. Each of the slide mechanisms other than the top-most slide mechanism includes a ramp section structured and dimensioned to engage its corresponding locking member in a manner such that when any one of the drawers is opened, the remaining drawers are locked in the closed position. The locking members may be a plurality of elongated U-shaped channels that are identically constructed. Each locking member has a first projection thereon that is engaged by the ramp section of the corresponding slide mechanism of a drawer such that opening and closing a drawer moves the locking member reciprocally in a vertical plane relative to the housing. A second projection on the locking member is positioned so as to interfere with any horizontal movement of the next adjacent slide mechanism above the drawer being opened, thus prohibiting any drawer above the one that is opened from being opened. In like manner, the same projection on each of the locking members below the drawer that is opened engages the slide mechanism that is extended for the open drawer and thus prohibits the locking elements below the open drawer from moving upwardly thus locking all of the drawers below the drawer that is opened. A third optional projection on each locking member is a motion limiting device which causes each locking member to assume an original position when all of the drawers are in a closed position.

It should be understood that various changes and modifications of the preferred embodiments described herein will be apparent to those skilled in the art. Such changes and modifications can be made without departing from the spirit and scope of the present invention and without diminishing its attendant advantages. It is, therefore, intended that such changes and modifications be covered by the claims herein.

What is claimed is:

1. A locking assembly for a housing having multiple vertically aligned drawers, the assembly allowing only one drawer to be opened at one time, comprising:

a slide mechanism attachable to at least one side of each drawer in said housing, said slide mechanism having at least an outer slide section and an inner slide section telescopingly mated within said outer slide section for normal sequential extension and retraction of the inner section with respect to the outer section wherein said outer and inner sections first extend together in mated relation before telescopingly sliding relative to each other when the drawer is opened and wherein said inner and outer sections first move relative to each other before together sliding in mated relation when the drawer is closed, said inner slide section having an end directable outwardly of said housing;

at least one locking member slidably attachable to the housing for reciprocal vertical movement;

a slide ramp on said outwardly directable end of the inner slide section except the inner slide section of the slide mechanism attachable to an uppermost drawer;

a first projection on the at least one locking member for association with the slide ramp on the outwardly directable end of said inner section except of the slide mechanism attachable to the uppermost drawer in a manner such that when said inner slide section is extended outwardly as a drawer is opened, the slide ramp engages the locking member first projection so as to force the at least one locking member vertically upward; and a second projection on the at least one locking member adjacent the slide mechanism for each of the corresponding drawers such that as the at least one locking member moves upwardly as any one of said drawers except the uppermost drawer is opened, the corresponding second projection is positioned in blocking relationship with its corresponding next upper adjacent slide mechanism so as to prevent any one of said drawers above the open drawer from being opened;

said slide ramp including a first section sloping inwardly and upwardly from the outwardly directable end of the inner slide section, and an uppermost section integrally formed with the upwardly sloping section and extending above the inner slide section, and a second section sloping inwardly and downwardly of said outwardly directable end from the uppermost section to the inner slide section such that if the normal slide sequence fails the at least one locking member can function properly by riding up the first sloping section and down the second sloping section when the slide is extended and then riding up the second sloping section and down the first sloping section when the slide is retracted.

2. A locking assembly as in claim 1 wherein the at least one locking member includes a third projection for resting on its associated slide mechanism only when the slide mechanism is retracted so as to limit the downward movement of the locking member as the slide mechanism is retracted.

3. A locking assembly as in claim 1 wherein the second projection on a locking member below an open one of said drawers engages the extended slide of the open one of said drawers if any one of said drawers below the open one of said drawers is attempted to be opened thus preventing any other one of said drawers from being opened when there exists a previously opened one of said drawers.

* * * * *